United States Patent [19]

Laux

[11] 4,199,973

[45] Apr. 29, 1980

[54] TWO-ARMED LEVER PRESS

[76] Inventor: Friedrich-Günther Laux, Alt-Moabit 19, 1000 Berlin 21, Fed. Rep. of Germany

[21] Appl. No.: 931,362

[22] Filed: Aug. 7, 1978

[30] Foreign Application Priority Data

Apr. 24, 1978 [DE] Fed. Rep. of Germany ..... 2817888

[51] Int. Cl.[2] ..... B21D 7/06

[52] U.S. Cl. ..... 72/410; 72/416

[58] Field of Search ..... 72/409, 410, 412, 414, 72/452, 353, 358, 416; 81/57.39; 29/758

[56] References Cited

U.S. PATENT DOCUMENTS

| | | | |
|---|---|---|---|
| 2,861,490 | 11/1958 | Rozmus | 72/409 |
| 3,342,059 | 9/1967 | Laux | 72/410 |
| 3,475,946 | 11/1969 | Laux | 72/409 |
| 3,756,064 | 9/1973 | Erdmann | 72/410 |

FOREIGN PATENT DOCUMENTS

| | | | |
|---|---|---|---|
| 735670 | 6/1966 | Canada | 72/410 |
| 2443883 | 9/1975 | Fed. Rep. of Germany . | |
| 259441 | 4/1964 | Netherlands | 72/410 |

*Primary Examiner*—Francis S. Husar
*Assistant Examiner*—Gene P. Crosby

[57] ABSTRACT

A two-armed lever press for attaching a terminal or coupling sleeve to electrical cables or the like used on an interchangeable die block, preferably of relatively adjustable parts which together define a die cavity which substantially completely embraces the work so that, when pressure is applied the material flow induced in the sleeve can take place in the longitudinal direction only. Because of the heavy stresses involved, the force-transferring zones of the press are equipped with roller and needle bearings at the moving parts.

13 Claims, 4 Drawing Figures

FIG. 3
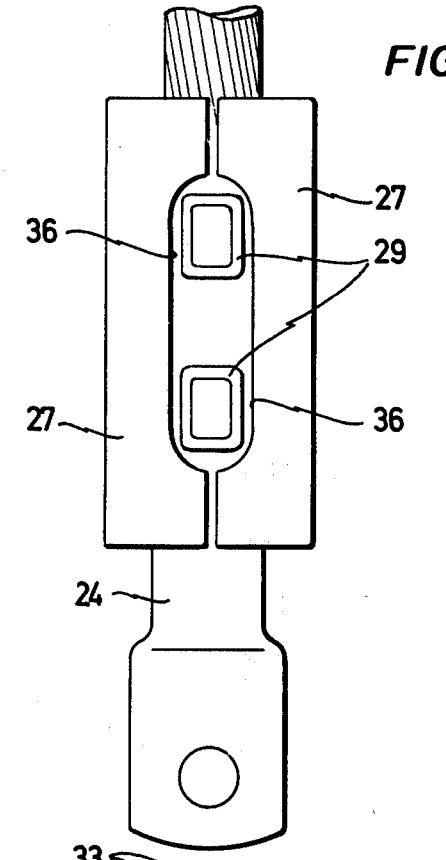
FIG. 4
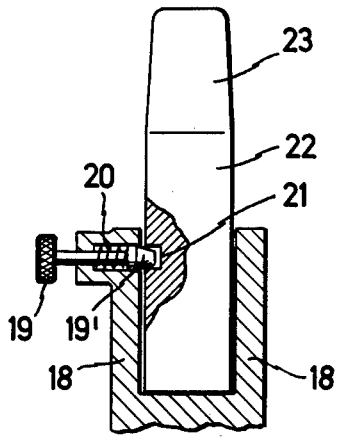
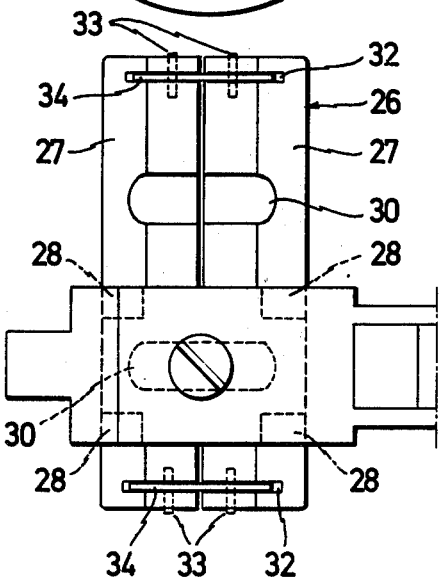
FIG. 2

TWO-ARMED LEVER PRESS

BACKGROUND OF THE INVENTION

The invention relates to a two-armed lever press, for the non-soldered connection of metallic parts such as terminal plugs, coupling sleeves, and so on (hereinafter embraced in the expression "terminal sleeve") to electrical cables, conductors or the like, in which the sleeve is pushed with the wire strands or filaments into a die in the press and acted on by a plunger to effect the pressing.

West German Patent Publication No. 2 443 883 discloses a lever press of this nature in which the die only partially embraces the terminal or coupling in the operative position and, when the pressing takes place, "squashes" the material of the sleeve in all directions. In practice it is found that the cross sectional form of the individual filaments or conductors can thereby be reduced to an impermissable extent by overstress. Thus this has the disadvantage that the original circular cross section of the sleeve in the zone of the joint can be flattened with the cable or the like, and thus the latter itself, during the pressing operation. Quite apart from this the conducting contact between the individual filaments or wires can be impaired, reducing the conductive capacity of the cable or the like in the area of the sleeve. As a consequence of the aforementioned deformation, losses due to electrical leakage can occur at the joint under high electrical tensions.

In the known forms of lever presses the transmission of power calls for the application of comparatively high stresses. In addition the sliding parts which are most stressed are exposed to heavy wear as a consequence of lubrication conditions which cannot in practice always be supervised.

SUMMARY OF THE INVENTION

An object of this invention is to reduce the power required to operate a press of this character. A further object is to increase the effectiveness and longevity of the press.

This result is achieved by the fact that the die means is a removable die block which substantially wholly embraces the sleeve during the pressing operation.

The advantage of this arrangement is that the terminal sleeve is closely confined by the die parts during the pressing operation and the material can flow only in the longitudinal direction of the terminal sleeve. The result of this is that both the now-elongated sleeve, and thus the cable itself, retains its original circular shape and deformations of the filaments or strands of the cable or the like are kept to a minimum. Moreover they maintain their relative positions to a maximum degree so that no other stressing occurs in any of the parts and good conductive performance is ensured between the cable and the sleeve.

However, comparatively high pressing forces must be applied to the sleeve during its change in length. It has been found by tests that because of the very heavy strains involved individual parts of the lever press are stressed almost to the material flow limits. For this reason, in accordance with a feature of the invention cylindrical roller bearings and needle bearings are provided in the transmission parts of the plunger, as will be described in more detail hereinafter. These special bearings, in which the rollers and needles can be directly built in to the device without any inner or outer cage, introduces a reduction of the power required up to 40%, thus making a correspondingly increased pressing force available for a given power applied.

To simplify maintenance a one-time lubrication, particularly using molybdemum disulphide, is employed. The transmission ratios are made such that, for example with a lever pressure of only 10 kilograms (kg), a maximum pressing pressure of 8–12 tons can be achieved.

BRIEF DESCRIPTION OF THE DRAWINGS

An embodiment of the invention is illustrated in the accompanying drawings which will hereafter be described in detail. In the drawings:

FIG. 2 is a plan view of the same,

FIG. 3 is a view from below of a detail of the press with a terminal sleeve and cable inserted, and FIG. 4 is a detail taken on the line IV—IV of FIG. 1.

DESCRIPTION OF THE PREFERRED EMBODIMENT

Figure 1:
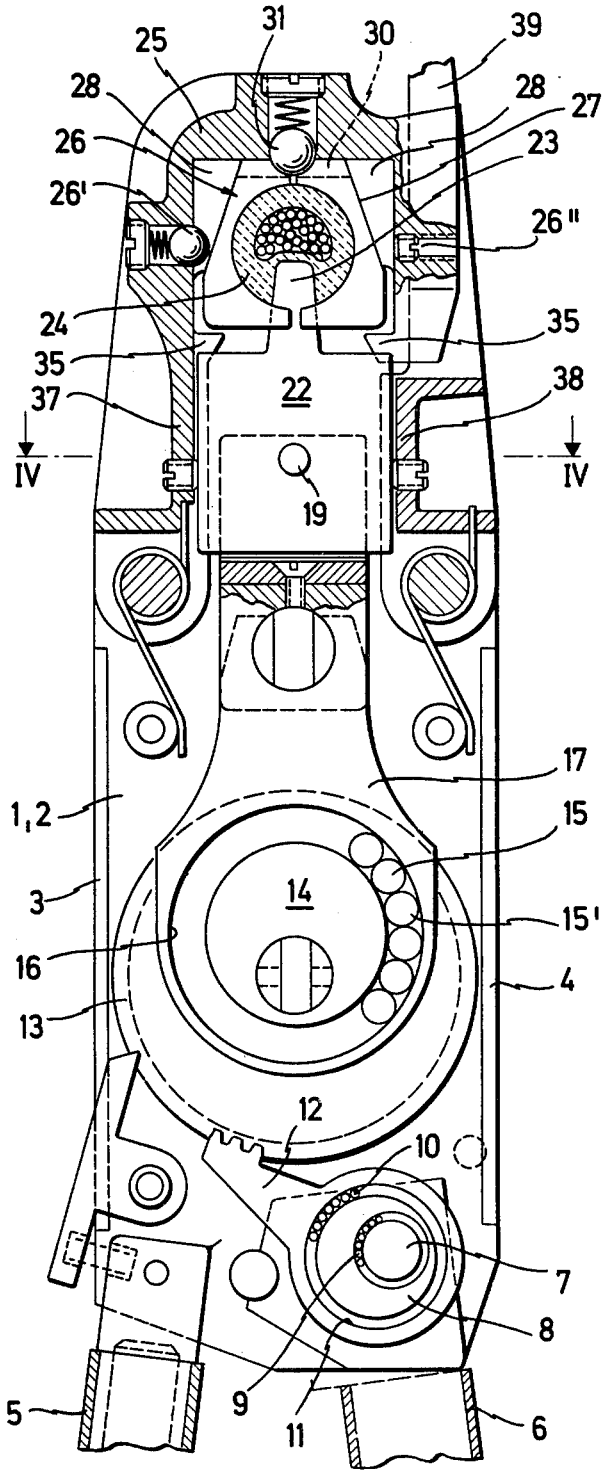
FIG. 1 is a partial side view of a lever press according to the invention.

The lever press illustrated has a housing comprising two side plates 1, 2 (only the rear plate has been shown in FIG. 1) and two end plates 3, 4 connecting the side plates along their longitudinal edges. Arranged between the side plates 1, 2 at the lower end thereof an arm constituting a hand lever 5 is rigidly connected to the plates 1, 2 and a second arm and hand lever 6 pivotally connected thereto. The lever 6 is mounted in a ratchet eccentric 8 firmly connected to the hand lever 6 through a pin 7 and a needle bearing race 9. The eccentric 8 is mounted in turn through a needle bearing race 10 in a circular hole 11 in a toothed pawl 12, so that reciprocating pivotal movement of the hand lever 6 turns a ratchet wheel 13, mounted between the plates 1, 2, in a stepwise movement. The wheel 13 carries a disc 14 which is eccentrically mounted, with the interposition of a cylindrical roller race 15, in a circular opening 16 in the enlarged end of a presser plunger 17 axially reciprocable in the housing 1–4. Thus the effect of the stepwise movement of the ratchet wheel 13 is to move plunger 17, and a head 22, carried at its upper end, in its axial direction, that is to say, as will be seen later, in the pressing direction.

The above-mentioned cylindrical roller bearing race 15 between the eccentric disc 14 and the presser plunger 17 comprises individually loose and insertable small cylindrical rollers 15' which have plane parallel ground end faces; an accurate machining of these bodies is essential to the 40% saving of power and increase in operative performance which is acquired in the present invention. The needle bearings 9 provided in the area of the pivotal lever arm confer approximately 5% increase in operating efficiency.

The plunger 17 is provided at its upper end with a pair of upstanding lugs 18 which between them receive the lower end of the head 22 and one of each carries a catch pin 19, with a conical tip 19', biassed by a compression spring 20 into engagement in a recess 21 in head 22. At its upper end the plunger head 22 has an upstanding pressing mandrel portion 23.

A bridge piece 25 is provided in the housing between the upper ends of plates 1, 2 and this accommodates a two-part die block 26 of substantially equilateral rhombus cross section, the block being inserted at right to the bridge piece, i.e. to the plane of the drawing in FIG. 1.

As will be seen from the latter the outer faces of the two parts 27 of this die block extend obliquely outwards and downwards so that the die block 26 is flared wedge fashion towards the press plunger head 22. The parts 27 of the die block (there could be more parts than in the arrangement shown) are supported against two pairs of ribs 28 which extend obliquely along the outer edges of bridge 25 and are correspondingly inclined at their inner edges. A setscrew 26'' on bridge 25 caters for centering the upper and lower die parts.

The two halves of the die block illustrated are hinged together through two small hinge plates 34 (FIG. 2) which engage in transverse slots 32 and are each pivotal around a pivot pin 33. The die block parts are urged together by a spring-pressed ball 26' and located at the upper side by a spring-pressed ball 31 on the bridge 25.

In operation a sleeve-form cable terminal 24 and the cable end are inserted in the press between the die block parts 27. In this position the die block 26 wholly embraces the terminal with the exception of the two projecting ends of the latter and, at the underside, a hole suited to the size of the plunger mandrel 23. By operation of the arm 6 the terminal sleeve can be deformed longitudinally under the action of the plunger mandrel 23 but not in any other way. On the other hand the pressure stresses are sufficiently high that where the outer longitudinal surfaces of the parts of the die block 27 are approximately parallel to one another any subsequent extraction out of the die block after pressing would be extraordinarily difficult.

In the present arrangement however the catch pin 19 can be operated to allow for retraction of the plunger mandrel 23 from the terminal sleeve 24. The pawl catch which hitherto has been provided at this part and engaged in the plunger mandrel has not proved sufficient to absorb a pull on the plunger mandrel. Thus for the first time it is now made possible for the mandrel to be forcibly released from the pressure zone after the pressing operation has taken place.

When the plunger mandrel 23 is pulled out, the die block 26 is held from below by two appropriately arranged retaining shoulders 35 so that there is play for release of stress on the parts 27 of the die block. One of these shoulders 35 is provided on a depending wall part 37 of the bridge 25 which, in conjunction with an opposed wall 38 of the bridge, provide a pair of cheeks confining the plunger head 22 in its operative position. The other shoulder 25 is provided at the lower end of a locking bar 39.

At the lower side of the die block in the separation gap between parts 27 there is an enlargement recess 36 so sized as to allow for the passage of the plunger mandrel 23 with some play. Provision may, as illustrated in FIG. 3, be made for the pressing of the sleeve at a plurality of places, to which end the plunger head 22 will have a corresponding multiplicity of mandrels 23 and the recess 36 sized to accommodate them. Instead of one such recess a plurality of recesses, each accommodating its own individual mandrel, can be used. To enable such a plurality of indentations 29, for example two, to be pressed into the terminal 24 at a uniform spacing, locating notches 30 are provided in the upper part of the die block 26 transverse to the longitudinal direction of the latter.

I claim:

1. A lever press for the non-soldered connection of a metallic terminal or coupling sleeve to an electrical cable, conductor or the like, comprising a housing carrying die means for receiving said sleeve and said cable or the like, a presser plunger having a projecting plunger mandrel for deforming said sleeve to grip it against the cable or the like, and two lever arms carried on said housing and relatively movable to operate said plunger, wherein said die means is a removable die block which substantially wholly embraces the sleeve during the pressing operation, said die block having an opening therethrough sized to receive said plunger mandrel.

2. A lever press according to claim 1, in which the die block is composed of at least two parts hinged together and recessed to define a die cavity between them, each of said parts having a portion of said opening for receiving said plunger mandrel.

3. A lever press according to claim 2, in which said housing includes a bridge piece receiving said die block and having spring-pressed means for locating said die block parts in working position.

4. A lever press according to claim 3, in which said bridge piece carries a locking lever for the die block, said locking lever and an opposed wall of the bridge piece having opposed projections for supporting the parts of the die block.

5. A lever press according to claim 1, in which one of said lever arms is pivotally mounted in said housing and is reciprocable to turn an eccentric bearing in said housing to operate said pressure plunger.

6. A lever press according to claim 5, in which said eccentric bearing includes a hole in an enlarged inner end of said presser plunger and the outer surface of an eccentric disc rotatable with a ratchet wheel in said housing, a cylindrical roller bearing race being provided between the inner wall of said hole and said outer surface.

7. A lever press according to claim 6, in which said pivotally mounted lever arm is connected through a second eccentric bearing in said housing to a toothed pawl in cooperative engagement with said ratchet wheel, needle bearings being provided in said second eccentric bearing.

8. A lever press according to claim 1, in which the presser plunger has a removable head formed with said projecting mandrel entering said die block to press said sleeve.

9. A lever press according to claim 8, in which the removable head is engaged between a bifurcated portion of the plunger body and is held in working position on said body by a spring-pressed catch in said body.

10. A lever press for the non-soldered connection of a metallic terminal or coupling sleeve to an electrical cable, conductor or the like, comprising a housing; a bridge piece in said housing; a die block having at least two hinged parts defining a die cavity between them, said parts removably received by said bridge piece wherein said bridge piece has spring-pressed means for locating said die block parts in working position and a die block locking lever and an opposed wall of said bridge piece having opposed projections for supporting said die block parts; a presser plunger for deforming said sleeve to grip it against the cable, conductor or the like; and two lever arms carried on said housing and relatively movable to operate said plunger; whereby said die block parts substantially wholly embrace the sleeve in the die cavity during the pressing operation.

11. A lever press according to claim 10, in which the outer faces of the die block are tapered and the bridge piece has inturned ribs of corresponding taper to engage and compress said die block parts together.

12. A lever press for the non-soldered connection of a metallic terminal or coupling sleeve to an electrical cable, conductor or the like, comprising a housing carrying die means for receiving said sleeve and said cable or the like, a presser plunger having a removable head formed with a projecting mandrel for deforming said sleeve to grip it against the cable or the like, and two lever arms carried on said housing and relatively movable to operate said plunger, wherein said die means is a removable die block which substantially wholly embraces the sleeve during the pressing operation, and said mandrel enters said die block to press said sleeve.

13. A lever press for the non-soldered connection of a metallic terminal or coupling sleeve to an electrical cable, conductor or the like, comprising a housing carrying die means for receiving said sleeve and said cable or the like, a presser plunger with a plunger mandrel for deforming said sleeve to grip it against the cable or the like, and two lever arms carried on said housing and relatively movable to operate said plunger, said die means being a removable die block embracing the sleeve within the area of the press during the pressing operation and said die block having at least one hole to receive said plunger mandrel.

* * * * *